US006106217A

United States Patent [19]

Knell

[11] Patent Number: 6,106,217

[45] Date of Patent: Aug. 22, 2000

[54] LIFT ARM ARRANGEMENT OF A CONSTRUCTION MACHINE

[75] Inventor: Harvey A. Knell, Yorkville, Ill.

[73] Assignee: Caterpillar Inc., Peoria, Ill.

[21] Appl. No.: 09/134,842

[22] Filed: Aug. 14, 1998

[51] Int. Cl.[7] ..... B66C 23/06

[52] U.S. Cl. ..... 414/722; 52/116

[58] Field of Search ..... 414/695.5, 722, 414/727, 694; 52/111, 116; 29/897, 897.2

[56] References Cited

U.S. PATENT DOCUMENTS

| | | | |
|---|---|---|---|
| 4,034,876 | 7/1977 | Yancey | 29/897 |
| 4,161,369 | 7/1979 | Moreno | 414/722 |
| 4,260,322 | 4/1981 | Cameron | 414/727 |
| 4,439,089 | 3/1984 | Anderson et al. | 414/722 |
| 4,576,543 | 3/1986 | Kuchyt et al. | 414/722 |
| 4,609,322 | 9/1986 | Quant | 414/685 |
| 4,798,512 | 1/1989 | Intveld | 414/722 |
| 4,904,151 | 2/1990 | Biemans et al. | 414/727 |
| 4,939,855 | 7/1990 | McCreary, Jr. | 414/722 |
| 4,955,779 | 9/1990 | Knackstedt | 414/723 |
| 5,024,010 | 6/1991 | Hulden | 37/118 R |
| 5,599,158 | 2/1997 | Ajilore | 414/722 |

FOREIGN PATENT DOCUMENTS

| | | | |
|---|---|---|---|
| 2379-657 | 10/1978 | France | 414/722 |

*Primary Examiner*—Robert P. Olszewski
*Assistant Examiner*—Bryan Jaketic
*Attorney, Agent, or Firm*—William C. Perry; Calvin E. Glastetter

[57] ABSTRACT

Conventional lift arm arrangements for construction machines include a pair of lift arms that are welded fabrications forming box-beams. The lift arms are typically connected by a cross tube that is welded to the inner walls of each lift arm. This type of construction creates an extremely heavy arrangement that requires several very labor intensive welding operations to manufacture. The present invention provides a lift arm arrangement that includes lift arms that are made of one-piece, cast members. Each lift arm includes an integral abutment portion that defines a surface that is adapted for welding to a cross tube assembly. The surface is configured to be spaced laterally from the inner side surfaces of each lift arm. Being so positioned, the stress concentrations created by the welded joint are moved to a location that is removed from the juncture between the cross tube assembly and the side surfaces of the lift arms.

11 Claims, 3 Drawing Sheets

LIFT ARM ARRANGEMENT OF A CONSTRUCTION MACHINE

TECHNICAL FIELD

This invention relates to a lift arm arrangement for a construction machine and more particularly to a lift arm arrangement having lift arms, each of which is made of a one piece casting.

BACKGROUND ART

Many construction machines are provided with a work implement that is attached to the front or rear portion of the machine. The work implement is typically connected by some type of lift arm arrangement that is controlled by the operator to manipulate the implement. In machines such as wheel loaders, a lift arm arrangement is provided that typically includes a pair of lift arms that extend between the machine and a bucket or other work implement. At least one hydraulic cylinder extends between the frame and the lift arms to pivot the lift arms with respect to the machine. A cross brace is normally secured between the two lift arms at a location that is positioned between the work implement and the machine frame. A tilt arrangement of one or more levers and at least one hydraulic cylinder is normally provided to pivot the implement with respect to the lift arms. Support for the tilt arrangement is provided by the cross brace through a plurality of brackets that extend from the cross brace. Since the work implement is spaced a substantial distance from the machine frame and generally is required to lift substantial weight during normal operation, the lift arm arrangement is subjected to severe loading of various types and from multiple directions.

In order to accommodate such severe loading, the lift arms have typically been constructed of very substantial welded fabrications. In order to accommodate torsional loading, the cross brace is formed of a tubular member that is welded to the inner face of each lift arm to prevent twisting of the lift arm arrangement. Since the lift arm arrangement is a welded fabrication, it inherently includes severe concentrations of stress between the connected components. This is especially true at the interface between the lift arms and the cross tube. In order to allow for the stress concentration at this junction, in which the components are positioned at 90° from one another, the size of the components in these areas must be increased as is the weld that secures them together. These large welds cause distortion between the members connected by the weld. Also large welds cause residual stresses which require a stress relieving process to attain satisfactory life. Further, since the weld between the cross tube and each lift arm is located at their juncture on the inner side of the lift arm, there is often not enough room allowed to take advantage of robotic welding techniques. Therefore the weld is done manually, which is a laborious time consuming operation. The end result is a lift arm arrangement that is exceptionally heavy that requires several labor intensive weldments to construct. This not only requires more counterweight at the opposite end of the machine to offset the massive lift arm structure, the added weight and manufacturing requirements adds substantially to the cost of the components.

The subject invention is directed to overcoming one or more of the problems set forth above.

DISCLOSURE OF THE INVENTION

In one aspect of the present invention, a lift arm arrangement is provided to connect a work implement to the frame of a machine. The lift arm arrangement includes a first lift arm, first and second end portions defined by the first lift arm and an abutment portion positioned between the first and second end portions. The abutment portion extends laterally from a first side of the first lift arm and terminates at a surface that is spaced from the first side a preselected distance. A second lift arm is provided that also has a first and second end portion and an abutment portion that is positioned therebetween. The abutment portion is positioned between the end portions of the second lift arm and extends laterally from a first side thereof. The abutment portion terminates at a surface that is spaced from the first side a preselected distance. The abutment portion of the second lift arm is positioned substantially in lateral alignment with the abutment member of the first lift arm. A tube assembly is included that has first and second end portions. The tube assembly is connected between the first and second lift arms with the first end portion thereof in welded engagement with the terminal surface of the abutment portions of the first lift arms. The second end portion of the tube assembly is likewise welded to the terminal surface of the abutment portion of the second lift arm.

In another aspect of the present invention a lift arm arrangement is provided that includes a pair of lift arms that are spaced from one another in parallel relation thereto. Each of the pair of lift arms includes a first and second end portion and inner and outer side portions that extend between the end portion of each lift arm. An abutment portion is defined by each of the lift arms and is positioned to extend from the respective inner sides of each lift arm. The abutment portions extend towards one another and are substantially aligned with one another. Each abutment portion defines a terminal surface that is spaced from the respective inner sides of the respective lift arms a preselected distance. A tube assembly is included that has a first end portion welded to the terminal surface of the abutment portion of one of the lift arms and a second end portion that is welded to the terminal surface of the abutment portion defined by the other of the lift arms.

With the lift arm arrangement set forth above, each lift arm may be constructed of a one piece casting. In doing so, the abutment portions may be an integral portion of the casting as are the pivotal connections on the end portions of the lift arms. Since the respective abutment portions are spaced from the inner sides of the respective lift arms, the welded connections that occurs between the abutment portions and the tube assembly are spaced inwardly from the inner side portions of the respective lift arms. This reduces the stress concentration that typically exists when the weld occurs at the interface between the side portion of a lift arm and the tube assembly by replacing the weld with a casting that has a smooth transition. Also, since each lift arm is a one piece casting, it may be configured to have an I-beam shape. This results in a substantial weight reduction when compared to a box-beam or rectangular cross section configuration while allowing an increase in machine lifting capacity.

BEST MODE FOR CARRYING OUT THE INVENTION

Figure 1:
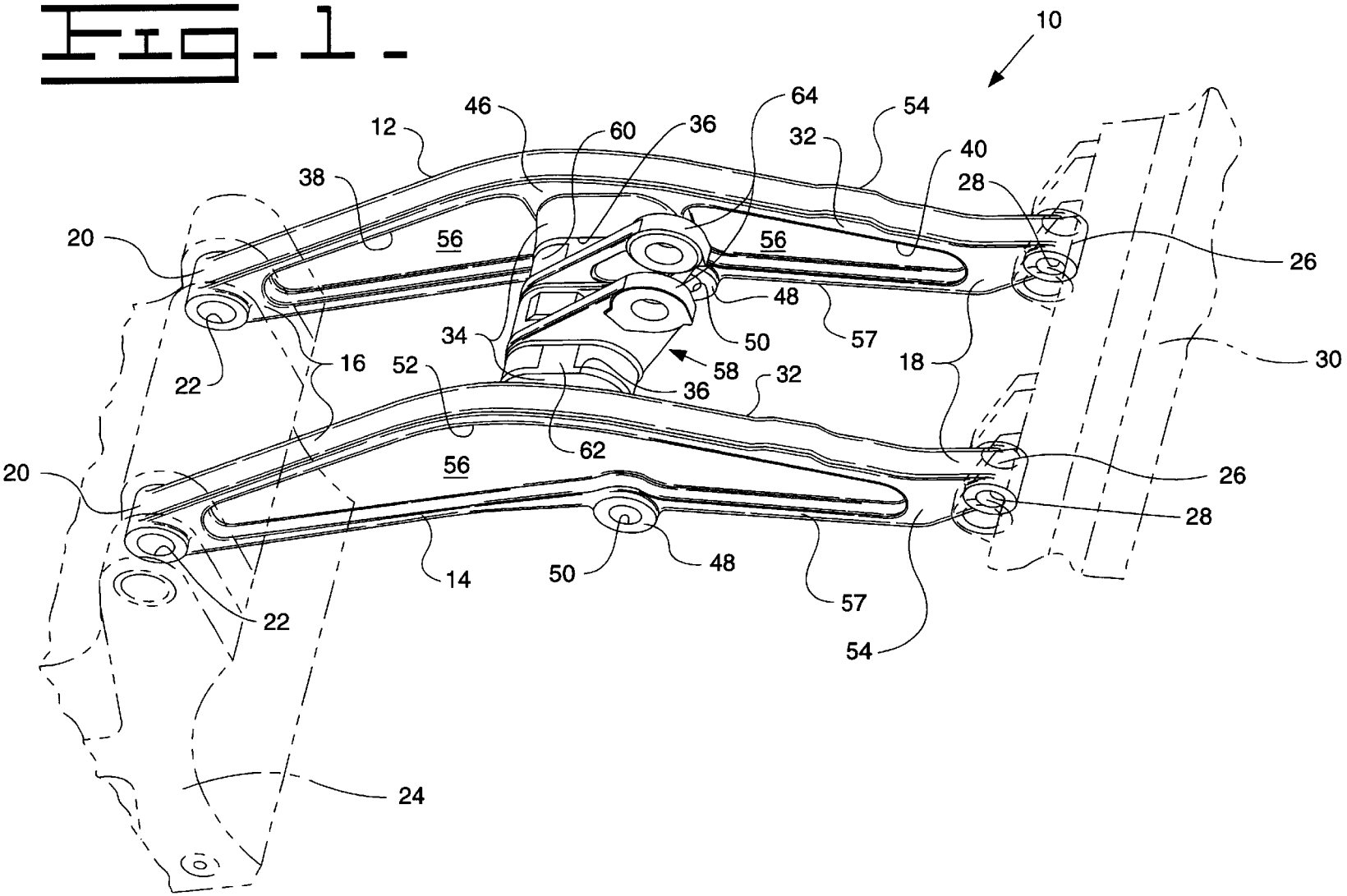
FIG. 1 is a diagrammatic isometric view of a portion of a lift arm arrangement that embodies the principles of the present invention.
Figure 2:
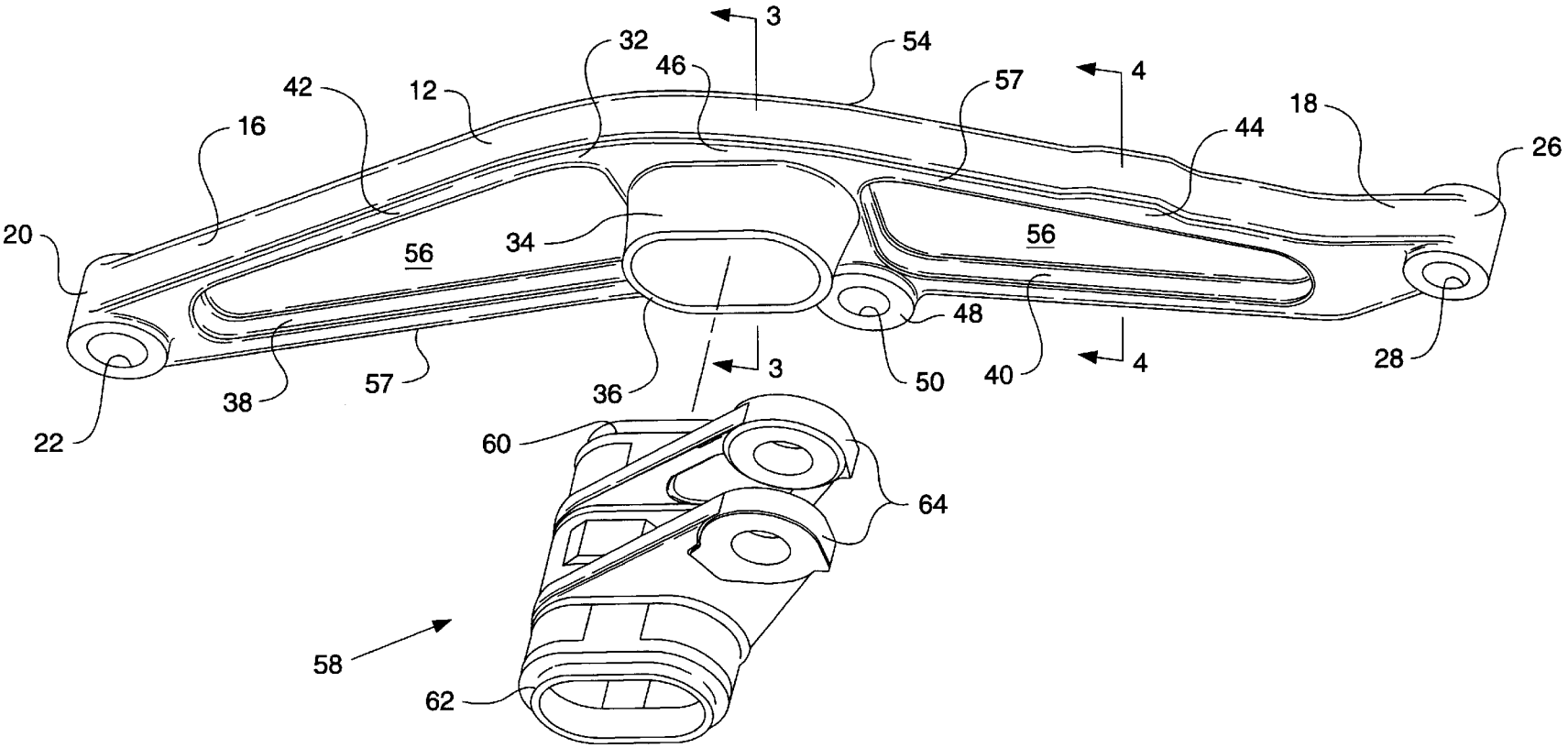
FIG. 2 is a diagrammatic, partially exploded, isometric view of the lift arm arrangement shown in FIG. 1 showing one of the lift arms and the cross member in full detail.

Referring now to the drawings, a lift arm arrangement is shown generally at 10. The lift arm arrangement 10 is comprised of a pair of lift arms 12 and 14 that are positioned in spaced parallel relation to one another. The lift arms have substantially identical components, however they are configured to be mirror images of one another. Since each lift arm is substantially identical, only one will be described in detail, it being understood that the reference numerals will apply to similar components on each lift arm.

Each lift arm 12 and 14 has a first end portion 16 and a second end portion 18. The first end portion 16 of each lift arm define a first boss portion 20 that has a bore 22 defined therethrough. The bore 22 is adapted to received a pin (not shown) that pivotally mounts the first end portion 16 of each lift arm 12 and 14 to the frame 24 of a construction machine, such as a wheel loader (not shown). In a similar fashion, the second end portion 18 of each lift arm defines a second boss portion 26 that in turn, defines a bore 28 that extends therethrough. The second boss portion 26 is adapted to receive a pin (not shown) that pivotally mounts a work implement 30 to the second end portions 18 of each lift arm 12 and 14.

Each lift arm has a first or inner side wall surface 32 that extends between the first and second end portions 16 and 18, respectively. An abutment portion 34 extends laterally from the inner side wall surface 32 of each lift arm in a manner wherein the respective abutment portions extend towards one another. Since the lift arms are mirror images of each other, the respective abutment portions 34 are laterally aligned with each other. Each abutment portion 34 extends laterally from the respective inner side wall surface 32 a pre-selected distance and terminates at a surface 36. The abutment portions 34 are tubular in configuration and the terminal surface 36 is substantially continuous about the tubular portion 34.

The inner side wall surface 32 of each lift arm 12 and 14 is interrupted by a pair of recesses 38 and 40 that divide the lift arms into first and second longitudinally spaced portions 42 and 44. The first recess 38 is positioned on the first portion 42 of the lift arm that extends between the first end portion 16 of the lift arms and the abutment portions 34. The second recess 40 is defined in the second longitudinal portion 44 that extends between the abutment portions 34 and the second end portions 18 of the lift arms. The recesses 38 and 44 create a centrally disposed land 46 on which the abutment portions 34 are positioned. A third boss portion 48 is defined by the lift arm in the land area adjacent the abutment portion. The third boss portion 48 defines a bore 50 that is adapted to receive a pin (not shown) that rotatably mounts an end of a hydraulic cylinder (not shown). The hydraulic cylinders extends between the machine frame and the lift arms 12 and 14 and function to raise and lower the lift arms about the first end portions 16 thereof.

Figure 4:
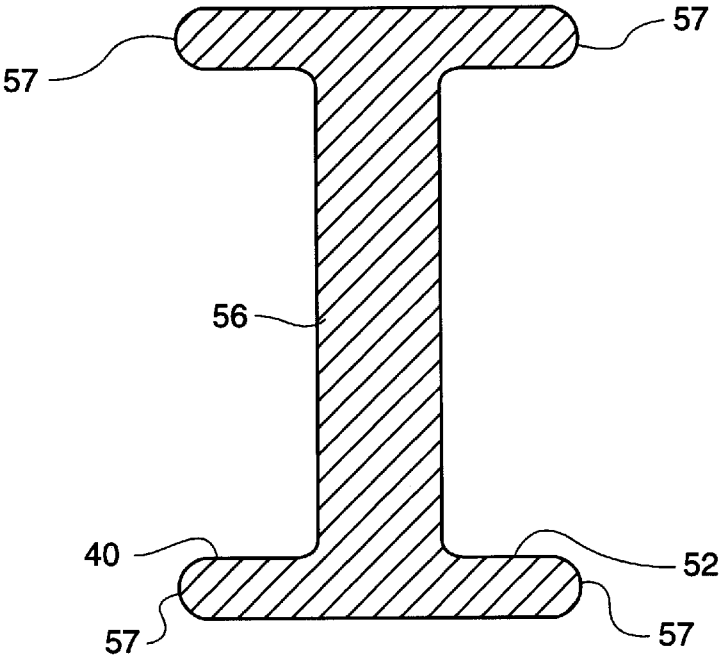
FIG. 4 is a diagrammatic section view taken along lines 4—4 in FIG. 2.
Figure 3:
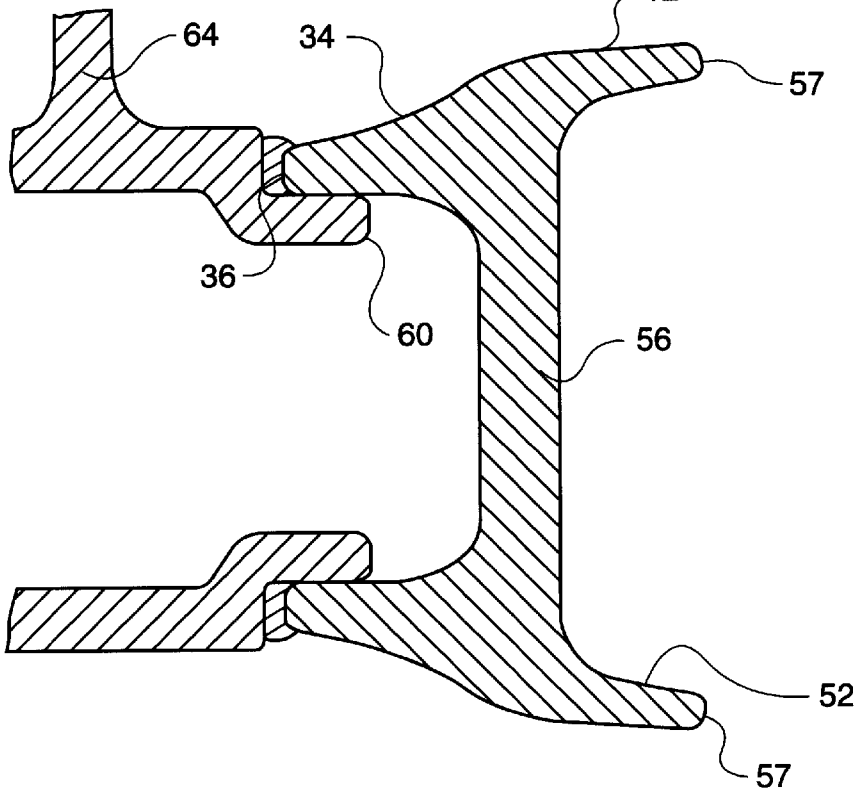
FIG. 3 is a diagrammatic section view taken along lines 3—3 in FIG. 2.

A third recess 52 is defined on a second or outer side wall surface 54 defined by each lift arm 12 and 14. The third recess 52 extends substantially the entire distance between the first and second end portions 16 and 18, respectively, of each lift arm. The first, second and third recesses 38, 40 and 52 respectively, are configured such that a centrally disposed web portion 56 is defined to extend entirely between the first and second end portions 16 and 18 of each lift arm. The recesses combine in such a manner to define an outer flange 57 around each of the lift arms to create an I-beam configuration. This is shown best in FIGS. 3 and 4.

A tube assembly 58 is positioned to extend between the lift arms 12 and 14. The tube assembly defines a first end portion 60 that is connected to the terminal surface 36 defined by the abutment portion 34 of the first lift arm 12 by welding. The tube assembly also defines a second end portion 62 that is welded to the terminal surface 36 defined by the abutment portion 34 of the second lift arm 14. The tube assembly 58 also defines a pair of spaced brackets 64 that extend upward from the tube assembly as viewed in the drawings. The brackets 64 are positioned substantially centrally between the lift arms and are adapted to pivotally mount a lever (not shown) of the tilting arrangement. In addition to mounting portions of the tilt arrangement, the tube assembly transfers torsional loads from one lift arm 12 to the other 14 to resist twisting and deformation of the lift arm assembly 10.

INDUSTRIAL APPLICABILITY

In the lift arm arrangement discussed above, each of the lift arms 12 and 14 are constructed of a one-piece casting. Being so constructed, the first and second bosses 20 and 26 respectively, as well as the abutment portions 34, are formed as an integral part of each lift arm. This greatly reduces the amount of welding that is required to complete a lift arm arrangement 10 when compared with those arrangements using fabricated lift arms. Also, since the welds have a lower allowable stress than the materials that they join, the section can be smaller for equal service life.

Another advantage of having a cast lift arm resides in the formation of the first, second and third recesses 38, 40 and 52 respectively, during the casting process. The depth of the recesses is controlled to form the centrally disposed web portion 56. The web portion 56, coupled with the flanges 57 formed by the outer edges of the recesses, provides each lift arm with an I-beam configuration. It is widely known that a configuration of this type will withstand greater loads which allows the overall weight of the lift arm to be reduced by as much as 20%. The reduction in weight of the lift arms translates into a reduction in weight of the counterweight required on the opposite end of the machine. Still further, the weight reduction of the lift arms results in a reduction in the force input which in turn reduces the power required for lifting a given payload. Therefore it can be seen that an overall reduction in weight for virtually the entire machine may be realized which in turn, greatly reduces the cost of the machine.

Another feature provided by this lift arm arrangement is the improvement in manufacturability. Since the abutment portions 34 are cast into the lift arm design, the terminal surface 36, or surface that will interface with the tube assembly 58 may be specifically positioned. In the subject invention, the abutment portion is spaced from the inner side surfaces 32 of the lift arms. This provides a surface, terminal surface 36, to which the tube assembly is welded. Since the weld is spaced from the inner side surface, the stress concentrations normally experienced with welded assemblies are moved away from the inner side surface to a location that has a geometry with a much lower stress concentration factor. The lower stress concentration allows a smaller weld. Smaller welds, in turn, cause less distortion of the joined parts and less internal stresses due to differential temperatures during welding. In addition, the spacing between the weld and the inner surface of the lift arms allows the use of programmed or robotic welding equipment which is much more cost effective than manual welding operations.

Other aspects, objects and advantages of this invention can be obtained from a study of the drawings, the disclosure and the appended claims.

What is claimed is:

1. A lift arm arrangement adapted for connecting a work implement to a frame of a machine, comprising:

a first lift arm, having first and second end portions and an abutment portion positioned between the end portions, said abutment portion extending laterally from a first side of the first lift arm and terminating at a surface that is spaced from the first side a preselected distance, the first lift arm being a one piece casting;

a second lift arm, having first and second end portions and an abutment portion positioned therebetween, said abutment portion extending laterally from a first side of the second lift arm and terminating at a surface that is spaced from the first side a preselected distance, said abutment portion being positioned for lateral alignment with the abutment portion of the first lift arm, the second lift arm being a one piece casting;

a tube assembly having first and second end portions and being secured between the first and second lift arms with the first end portion thereof welded to the terminal surface of the abutment portion of the first lift arm and the second end portion welded to the terminal surface of the abutment portion of the second lift arm;

wherein the first end portions of each lift arm define a first boss portion having a mounting bore defined therein, said first boss portions being formed as an integral portion of the casting;

wherein the second end portions of each lift arm define a second boss portion having a mounting bore defined therein, said second boss portion being formed as an integral portion of the casting;

wherein a third boss portion having a mounting bore defined therein is defined in each lift arm in an area adjacent the abutment portions, said third portion being formed as an integral portion of the casting.

2. The lift arm arrangement as set forth in claim 1 wherein each lift arm defines a first portion between the first end portions thereof and the abutment members that is shaped in the form of and I-beam.

3. The lift arm arrangement as set forth in claim 2 wherein each lift arm defines a second portion that extends between the abutment portions and the second end portion thereof, said second portions being shaped in the form of an I-beam.

4. The lift arm arrangement as set forth in claim 1 wherein the abutment portions of each of the lift arms are defined by a tubular portion that extends from a web portion that extends longitudinally along the central portion of each lift arm and is formed as an integral portion of the casting.

5. The lift arm arrangement as set forth in claim 1 wherein the tube assembly includes a pair of racket members that are adapted to pivotally mount a lever member substantially centrally between the first and second lift arms.

6. A lift arm arrangement, comprising:

a pair of lift arms, each having first and second end portions and inner and outer side surfaces that extend between said end portions, said lift arms being positioned in spaced, parallel relation to one another;

an abutment portion defined by each of the lift arms, said abutment portions being positioned to extend from the respective inner side surfaces of each lift arm towards one another substantially in lateral alignment with one another, said abutment portions each defining a terminal surface that is positioned a preselected distance from the respective inner side surfaces of the lift arms;

a tube assembly having a first end portion welded to the terminal surface of the abutment portion of one lift arm and a second end portion that is welded to the terminal surface of the abutment portion of the other of the lift arm;

wherein the respective first end portions of each lift arm are pivotally mounted to a frame of a machine;

wherein the respective second end portions of each lift arm are pivotally mounted to a work implement;

wherein a third pivotal mounting is defined as an integral portion of each lift arm in an area adjacent the abutment portion.

7. The lift arm arrangement as set forth in claim 6 wherein a first recess is defined on the inner side surfaces of a first portion of each lift arm, said first portion extending between the first end portions of each lift arm and the respective abutment portions, and a second recess defined on the inner side surfaces of a second portion of each lift arm, said second portions extending between the abutment portions of the respective lift arms and the respective second end portions thereof.

8. The lift arm arrangement as set forth in claim 7 wherein a third recess is defined in each of the outer side surfaces of each lift arm and extends between the first and a second portions thereof, said first second and third recesses being configured in such a manner to from a centrally disposed web that extends between the first and second end portions of each lift arm to form each lift arm in substantially an I-beam configuration.

9. The lift arm arrangement as set forth in claim 6 wherein each lift arm is formed from a one-piece casting and the pivotal mountings defined by the first and second end portions of each lift arm are defined as an integral part of the respective castings.

10. The lift arm arrangement as set forth in claim 8 wherein each abutment portion is tubular in configuration and extends laterally from the centrally disposed web.

11. The lift arm arrangement as set forth in claim 6 wherein each abutment portion is positioned substantially centrally between the end portions of the respective lift arms.

* * * * *

UNITED STATES PATENT AND TRADEMARK OFFICE

CERTIFICATE OF CORRECTION

PATENT NO. : 6,106,217
DATED : August 22, 2000
INVENTOR(S) : Harvey A. Knell

It is certified that error appears in the above-identified patent and that said Letters Patent is hereby corrected as shown below:

In the Specification

In the title page, under heading [19] "UNITED STATES PATENT", after "Knell", insert ---et al .---.

In the title page, in heading [75] Inventor:, after "Ill.", insert ---; Eric A. Reiners, Saint Charles, Ill.---.

In the Claims:

Claim 5,
Line 2, delete "racket" and substitute ---bracket---.

Signed and Sealed this

Tenth Day of July, 2001

*Attest:*

Nicholas P. Godici

*Attesting Officer*

NICHOLAS P. GODICI
*Acting Director of the United States Patent and Trademark Office*